US005855125A

United States Patent [19]

Lohmueller et al.

[11] Patent Number: 5,855,125

[45] Date of Patent: Jan. 5, 1999

[54] METHOD FOR CONSTRUCTING A DOUBLE FACE FABRIC AND FABRIC PRODUCED THEREBY

[75] Inventors: Karl Lohmueller, Hampstead, N.H.; Moshe Rock, Andover; Douglas Lumb, Metheun, both of Mass.

[73] Assignee: Malden Mills Industries, Inc., Lawrence, Mass.

[21] Appl. No.: 939,078

[22] Filed: Sep. 26, 1997

Related U.S. Application Data

[63] Continuation-in-part of Ser. No. 686,331, Jul. 25, 1996, which is a continuation-in-part of Ser. No. 507,800, Jul. 26, 1995, abandoned.

[51] Int. Cl.[6] ..... D04B 1/02; D04B 1/22; D06C 11/00

[52] U.S. Cl. ..... 66/196; 28/162

[58] Field of Search ..... 66/87, 192, 195, 66/196, 197; 28/162

[56] References Cited

U.S. PATENT DOCUMENTS

| | | | |
|---|---|---|---|
| 3,855,820 | 12/1974 | Kohl | 66/87 |
| 3,921,418 | 11/1975 | Apken | 66/87 |
| 4,233,824 | 11/1980 | Schneider | 66/87 |
| 4,302,953 | 12/1981 | Wilkens | 66/87 |
| 4,315,419 | 2/1982 | Kerbichler et al. | 66/87 |
| 4,567,075 | 1/1986 | Krawczyk | 28/162 X |
| 4,712,281 | 12/1987 | Scheller | 28/162 |
| 4,785,558 | 11/1988 | Shiomura | 66/196 X |
| 5,396,859 | 3/1995 | Fan | 28/162 |

*Primary Examiner*—John J. Calvert
*Attorney, Agent, or Firm*—Gottlieb, Rackman & Reisman, P.C.

[57] ABSTRACT

A method of constructing a double face fabric is provided. The first step in the method is to knit a three dimensional knit fabric which has a first fabric layer, a second fabric layer and a plurality of yarns that interconnect the two layers. The three dimensional knit fabric is prepared using a conventional double needle bar warp knitting machine. Then, the yarn connecting the two layers is cut, resulting in two pieces of fabric having a velvet surface on one side, and a flat knit surface on the other. The flat knit surface is then raised by a process such as napping to pull portions of the pile yarns through the fabric layer to the technical back, in order to form a pair of double face fabrics, each with a first velvet surface and a second fleece surface. Preferably, the fabric is knit so that after napping it can be stretched. In this manner a wide variety of fabrics can be created.

35 Claims, 6 Drawing Sheets

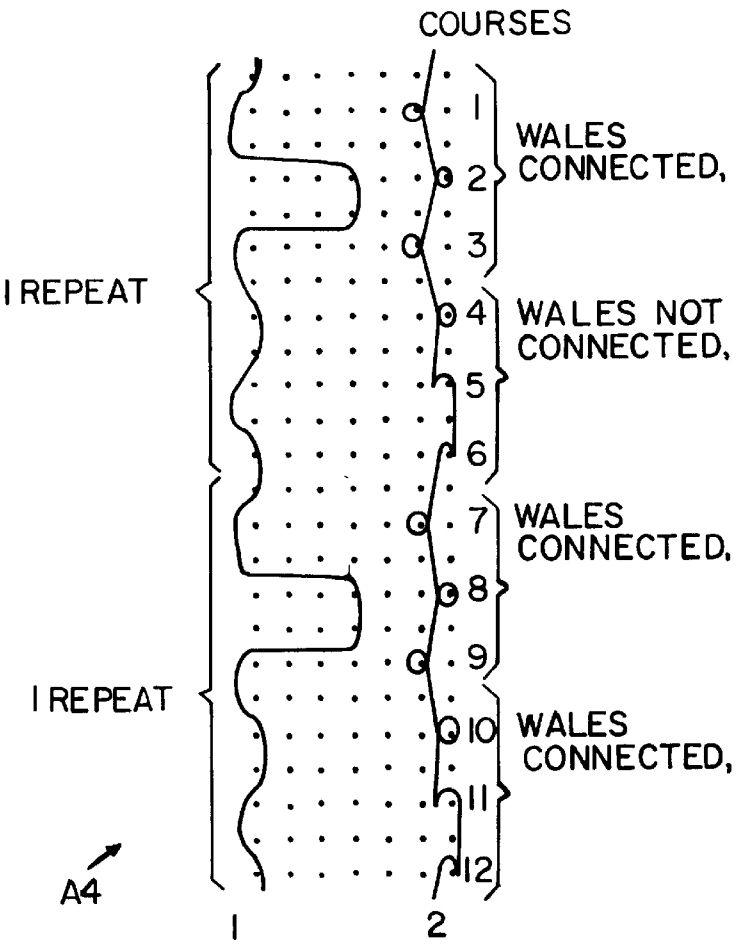
FIG.7A
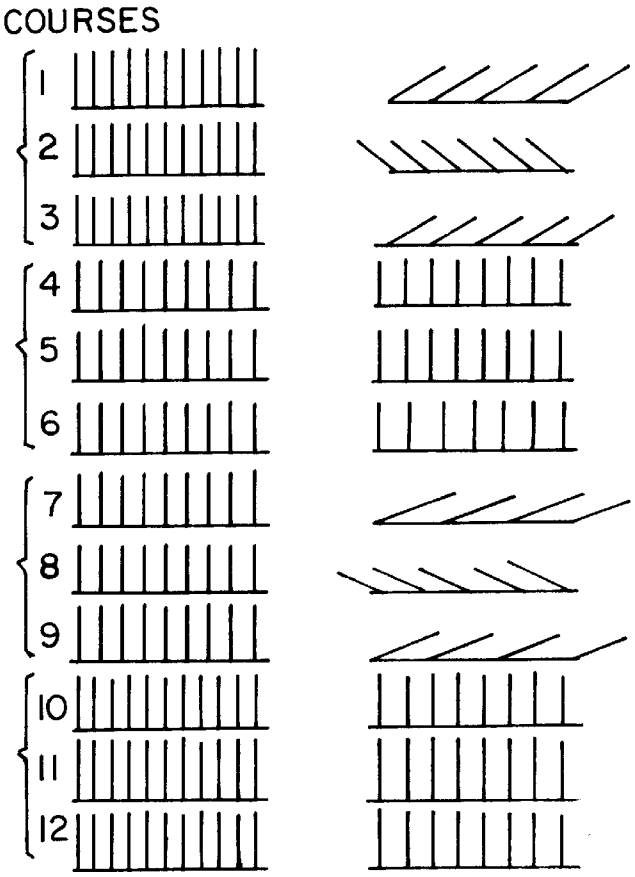
FIG.7B
FIG.7C

METHOD FOR CONSTRUCTING A DOUBLE FACE FABRIC AND FABRIC PRODUCED THEREBY

BACKGROUND OF THE INVENTION

This application is a continuation-in-part of application Ser. No. 686,311 filed Jul. 25, 1996, and which is continuation-in-part of application Ser. No. 08/507,800, filed Jul. 26, 1995, now abandoned.

This invention relates to a fabric that has a raised surface on both faces or sides, and more particularly to a method for making such fabric by utilizing a double needle bar warp knitting machine.

It is well known in the fabric field to use a warp knitting machine in the manufacture of velvet. A three-dimensional knit fabric is knit on a machine having two needle beds with multiple guide bars. Two warp knit fabrics with yarn connecting the two fabrics are formed (see U.S. Pat. No. 3,855,820). After knitting, the fabrics are split into two pile fabrics by cutting the yarn connecting them. Each of the two fabrics has a flat warp knit side and a pile side. The flat side is known as the technical back and the pile side is known as the technical face of the fabric (Raz, Dr. S.: "Warp Knitting Production," Verlag Melliand Textilberichte GmbH, Heidelberg).

Typically, the technical face is brushed to separate the individual fibers in each yarn bundle and create a face finished fabric often referred to as velvet. The flat side, the technical back, is typically not processed and remains in the as-knit state.

Because only one side of the fabric is face finished, its use is limited to applications in which the technical back is unexposed. As an example, garments made with single sided face finished fabric with the pile to the outside must be lined to avoid contact of the harsher technical back with the wearer's skin.

It is generally understood in the textile community that double faced fabrics overcome the inherent disadvantages of single faced fabrics for end uses in which both sides are utilized.

Warp knit fabrics provide inherent technical features. For example, they can be engineered to have as high a degree of dimensional stability and durability as woven fabrics, properties that are desirable in many end uses and that are not available in weft knit fabrics. Because the velvet on the pile side consists of individual fibers of yarn bundles that are anchored in the warp knit fabric, the velvet is more resilient than other pile fabrics in which the surface is raised by simply tearing fibers out of the stitch. This resilience is maintained, even after repeated laundering, with the result that the velvet look is maintained and fiber clumps are not formed. Warp knit fabrics made on double needle bar machines have the added benefit of providing enhanced thermal properties by control of fabric thickness and density. Warp knit fabrics made on tricot machines (see U.S. Pat. No. 4,712,281) can also be face finished on both sides, but do not provide the range of thermal properties or resilience possible on double needle bar equipment.

Forming a fleeced surface onto a woven or warp knit fabric is well known, as disclosed, for example, by U.S. Pat. No. 4,712,281 (Schella).

However, all the existing methods are unsatisfactory because they form the fleece by breaking the fibers and yarns. The resulting fabric is less durable because the fabrics and yarns are stressed. Moreover, any patterns formed on the fabric lose their distinctiveness once the fabric is distorted during napping.

Accordingly, it is desirable to provide fabric which overcomes the above disadvantages.

SUMMARY OF THE INVENTION

Generally speaking, in accordance with the invention, a method of constructing a double face fabric is provided. The first step in the method is to knit a three dimensional fabric using a conventional double needle bar warp knitting machine which has a first knit fabric layer, a second knit fabric layer and a plurality of yarns that interconnect the two knit layers. Then, the yarn connecting the two layers is cut, resulting in two pieces of fabric having a pile surface on one side (the technical face, the side that is cut), and a flat knit surface on the other (the technical back). The technical face is brushed to separate the individual fibers in each yarn bundle to create a velvet. The technical back of each fabric is raised by a conventional process such as napping to form two double face fabrics, each with a velvet surface on the technical face and a raised fleece surface on the technical back.

Significantly, the yarn (the yarn filaments) that interconnects the two knit layers is plaited around the yarn of the knit layers. Also, it is preferred that the interconnecting yarn has a bulk somewhat greater than the bulk of the yarn of the two knit layers. Finally, between 20–70% of the interconnecting yarn is pulled through the base layer to form said fleece.

The double face fabric produced by the inventive method may be used in a variety of applications, including coats, sweaters, blazers, blankets, throws and slippers. Either surface of the fabric may be worn against the skin or undergarment of the wearer. If the connecting yarn is treated to be hydrophilic, the velvet side may be worn on the inside and will wick liquid moisture away from the wearer's skin. If the connecting yarn is treated to be water repellent, the velvet side may be worn on the outside to provide the wearer protection from rain. Alternatively, the double face fabric may be treated for durable water repellency by a conventional padding operation during finishing, in which event, either side may be worn on the outside.

In one embodiment of the invention the knit layers are structured so that they can be stretched either along their width, along their length or both. In this manner very wide knit fabrics can be made as compared to the prior art. Moreover, stretching the fabric sideways causes the pile yarn to take new orientations thereby generating three dimensional effects and patterns which were not previously possible.

Accordingly, it is an object of the invention to provide a method for preparing a double face fabric.

Another object of the invention is to nap the flat side of the fabric made on a double needle bar warp knitting machine in order to form a double face fabric.

A further object of the invention is to provide a double face fabric for enhancing the transport of moisture away from the wearer's skin.

Still another object of the invention is to provide a double face fabric having durable water repellency.

Yet a further object of the invention is to provide a double face fabric having thermal and insulative properties.

Yet another object of the invention is to provide a double face fabric having a velvet surface whose appearance is unaltered even after repeated laundering.

Still other objects and advantages of the invention will in part be obvious, and will in part be apparent from the following description.

The invention accordingly comprises the several steps and the relation of one or more steps with respect to each of the others, and the material or materials having the features, properties, and relation of constituents which are exemplified in the following detailed disclosure, and the scope of the invention will be set forth in the claims.

BRIEF DESCRIPTION OF THE DRAWINGS

For a fuller understanding of the invention, reference is made to the following description in connection with the attached drawings, in which:

FIG. 7A shows a partial view of fabric A4 of FIG. 6D;

FIG. 7B shows the orientation of the pile yarn fabric A4 before stretching; and FIG. 7C shows the orientation of the pile yarn for fabric A4 after stretching.

DETAILED DESCRIPTION OF THE PREFERRED EMBODIMENT

Figure 1:
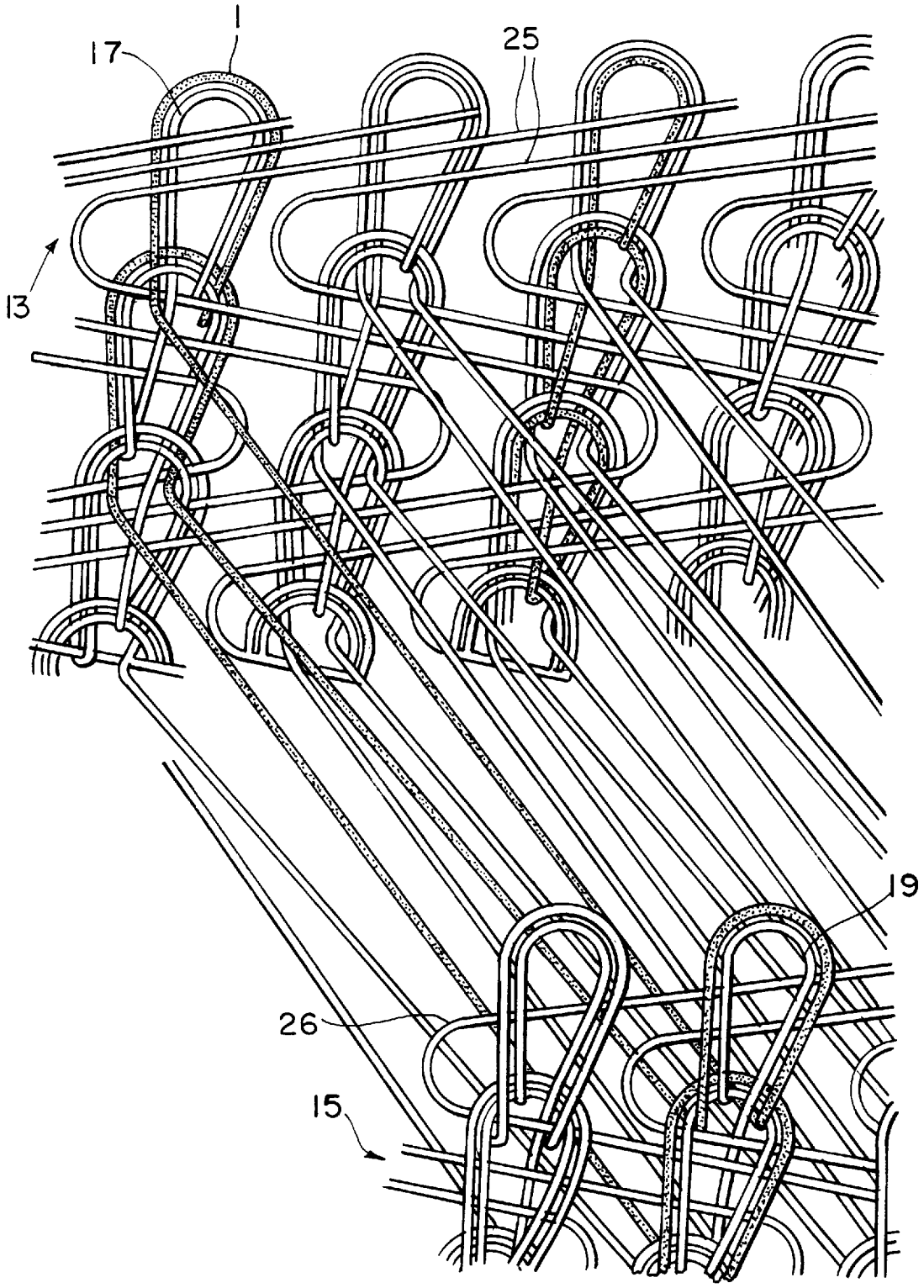
FIG. 1 is a side view showing the loop structure of a pile fabric produced on a double needle bar warp knitting machine.

The double face fabric of the invention is prepared by first knitting a three dimensional knit fabric on a double needle bar warp knitting machine commonly used in the manufacture of single faced velvet and well known in the art. As shown in FIG. 1, the three dimensional knit fabric is generally indicated at 11 and includes a first fabric layer 13 made from stitch yarn 17, a second fabric layer 15 made from stitch yarn 19, and pile yarn 21 interconnecting the two layers. In addition, knit fabric 11 includes backing yarn 25 and 26 which is knit into stitch yarn 17 and 19 respectively.

After fabric formation, the fabric may be dyed or printed, or the yarn that is used for the layers as well as to connect the layers may be dyed before fabric formation. The yarn may be either a synthetic material such as polyester, acrylic, nylon or olefin, and may be spun or filament (textured or oriented), or natural fibers such as cotton or wool, or modified natural materials such as rayon or acetate. The synthetic yarn filaments to connect the layers should be in the range of 0.3 to 6.0 denier per filament. The yarn for the layers may be any commercially available yarn since the layers have virtually no effect on the performance characteristics of the fabric.

As can be appreciated from FIG. 1, pile yarn 21 is plaited at one end around stitch yarn 19 and at the other end around stitch yarn 17. This plaited construction facilitates the napping process of the inventive method, as described below.

Significantly, it is preferred that the bulk of the pile yarn 21 be greater than that of stitch yarn 17 and 19. The bulk of the yarn is a measurement of the effective cross section of the yarn and is a yarn characteristic well known in the art. Yarn bulk is generally calculated by microscopic inspection. As can be appreciated, the more filaments a yarn has, the bulkier the yarn.

It has been found that a higher bulk ratio of pile yarn/stitch yarn enhances nappability, as well as minimizes damage and/or breakage of the stitch yarn during napping. A bulk ratio of at least 1½: 1 is preferred, and a ratio of about 3:1 is most desired.

Figure 2:
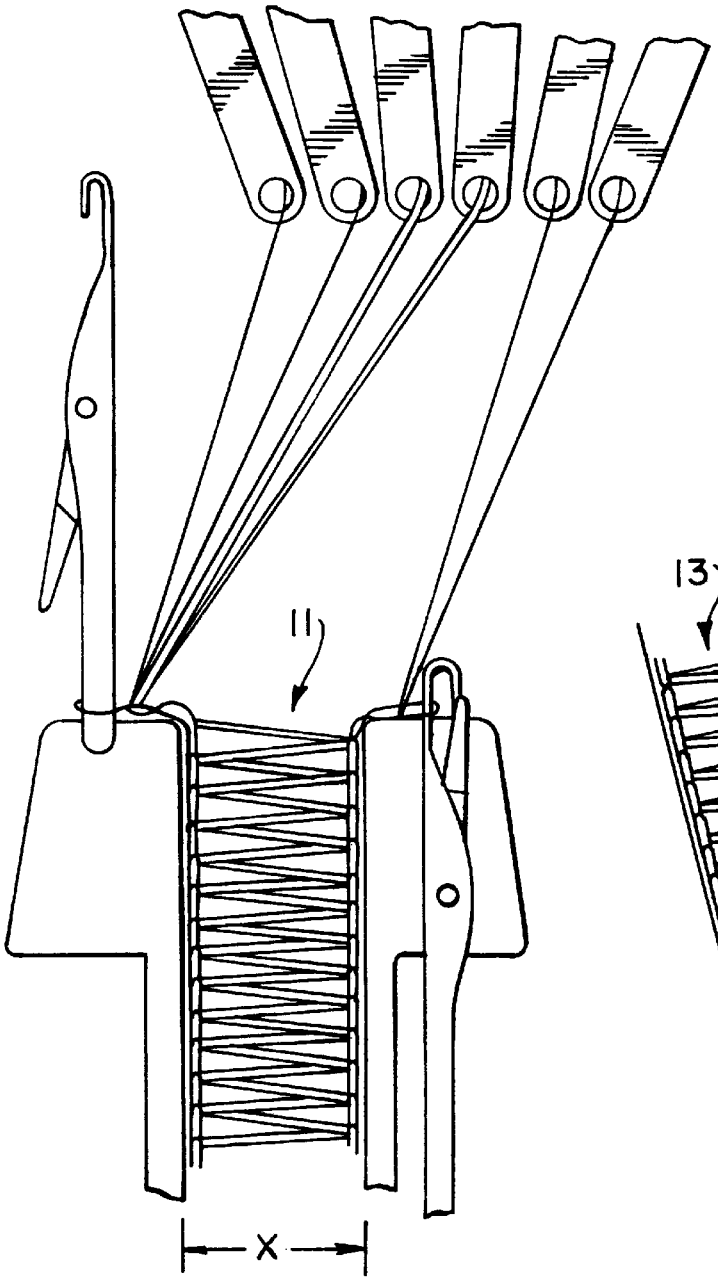
FIG. 2 is a side view in which knitting of a double needle bar fabric with six guide bars is shown.
Figure 3:
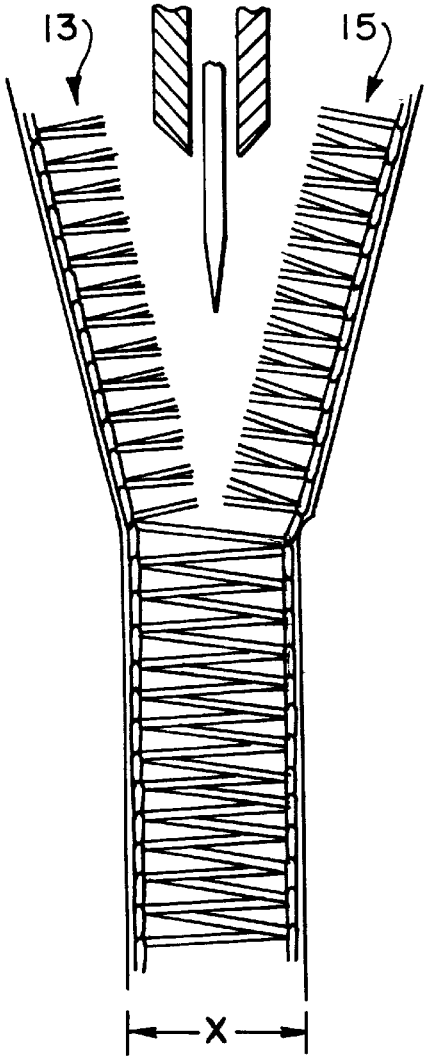
FIG. 3 is a side view in which the splitting of a double needle bar fabric is shown.

After producing the three dimensional knit, the yarn connecting the two surfaces is cut with a splitter (FIGS. 2 and 3) to form two intermediate fabrics with a velvet on the technical face and a flat surface or jersey on the technical back which is treated to form a fleece as described below.

Each intermediate fabric is formed of a base or substrate defined by the stitch yarns 17 or 19, backing yarns 25, 26 and the pile yarns 21 pleated around the stitch yarns as shown in FIG. 1.

After splitting, and prior to or during napping, heat may be applied to each fabric in order to further bulk the pile yarn or help it bloom, and thereby increase the bulk ratio of pile yarn/stitch yarn. Heating each fabric piece causes the pile yarn to shrink, effectively increasing the bulk thereof. Heating does not increase the bulk of the stitch yarn since the stitch yarn is held in place by the pile yarn.

Importantly, brushing, heating and steaming the fabric also straightens the fibers of the pile yarn, thus allowing the fibers to extend in parallel and to side with respect to each other.

Now the fabric is ready to be finished on the technical back or jersey side. For this purpose, a standard napper can be used. Such nappers are well known in the art of making textile fabrics. Presently available nappers are made with precise control mechanisms to adjust not only the cylinder speed and pressure but also the fabric speed and tension.

Figure 4:
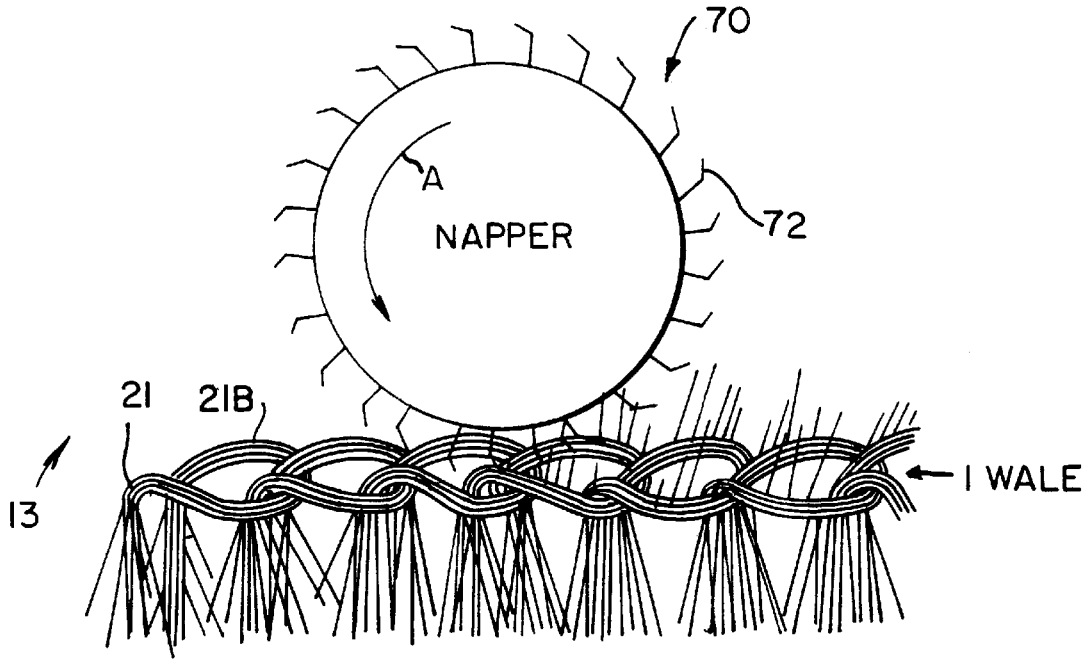
FIG. 4 shows a somewhat schematic side view of a napping process used in the subject invention.

Referring to FIG. 4, a fabric is being shown being napped by a napper graphically represented by a cylinder 70. Cylinder 70 is rotating in the direction indicated by arrow A and is provided with a plurality of angled fingers 72. Importantly, as can be seen in FIG. 4, the direction of rotation of cylinder 70 and the orientation of fingers 72 is such that the fabric 13 is napped in the direction of the loops 21A of the pile yarns 21. (In FIG. 4 the substrate has been omitted for the sake of clarity). It has been found that the process described herein functions much better if the napping is performed in this direction then in the opposite direction, i.e. against the loops 21A.

Figure 5A:
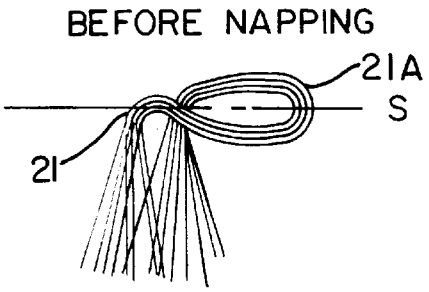
FIGS. 5A and 5B show a typical pile yarn loop before and after the napping process.
Figure 5B:
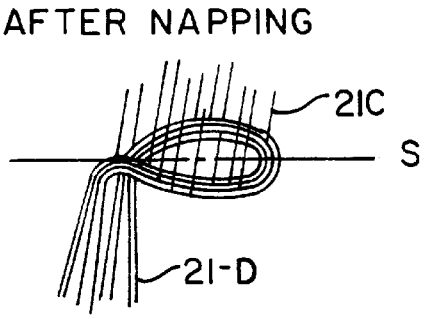

The result of the napping is that, as opposed to the prior where the fibers are broken in the process, in the present invention, a certain percentage of the fibers of the pile yarns 21 are physically pulled through the substrate. This aspect is dramatically illustrated in FIGS. 5A and 5B. In FIG. 5A a typical loop 21A is shown of a pile yarn 21. The free ends of the fibers of yarn 21 extend in the same direction (in FIG. 5A downward) away from and along one side of the substrate S. However, after napping, as shown in FIG. 5B, some of the fibers 21C have been pulled through the substrate S so that they are now disposed on the technical back as shown, while other fibers 21D remain on the technical face of the fabric as shown. The percentage of the fibers pulled through the substrate is dependent on a number of factors such as napper speed and tension and the speed and tension of the fabric. Therefore this percentage may be adjusted by adjusting these napping parameters so that between 20 and 80% of the fibers are pulled through the substrate.

Preferably, after raising the flat knit surface of each fabric piece, the raised surface can then be cleaned of loose fibers by additional brushing or napping and sheared to even the height therealong. Each resulting fabric piece thus comprises a velvet fabric surface on one side and a raised fleece surface that is a non-pilling functional velour on the other.

To further increase bulk ratio, it is also preferred that the pile yarn that is used is textured and the stitch yarn that is used is flat.

As discussed above, it is preferable to have a high bulk ratio of pile yarn/stitch yarn in order to enhance nappability. If the bulk ratio is low, the napping process could damage the stitch yarn, possibly breaking it, and rendering the fabric unsuitable as a finished fabric. In other words, a high bulk ratio improves napping since the pile yarn physically removes and protects the stitch yarn during the napping process.

As also discussed above, the plaited construction of the pile yarn around the stitch yarn improves the napping process that is performed on the technical back of each of the fabric pieces. By plaiting the pile yarn around the stitch yarn, the stitch yarn is insulated from attack when napping—only the pile yarn is napped.

The said stitching yearn gives dimensional stability and strength to the fabric; it does not add any aesthetic value to the fabric. It is tried to keep this yarn invisible and therefore of finer count. The bulk of the pile yarn is important to give fullness, bulk, warmth and aesthetic value to the fabric. Bulk and loftiness are given to the fabric without adding weight by using textured pile yarns versus flat yarns.

The resulting fabrics each have a velvet side and a fleece side. On the velvet side the tufts of the pile yarn protrude the support fabric in wales and courses. The tufts are arranged horizontally (courses) and vertically (wales) in rows with some distance between them in both directions of the fabric. When the unnapped fabric is folded so that the velvet is on the outside, these rows can be seen with the underlying support fabric. This braking of the fabric is less desirable and does not exist on the fleece side. Here the fibers are not arranged in tufts and rows because the fiber ends are pulled randomly out of the pile yarn by the napper wire and are distributed evenly over the napped fabric to form a fleece. By folding the fabric so that the fleece side is on the outside, no rows of tufts are visible. The fleece side of the fabric with 30 to 50% of the pile fibers has as good a cover as the velvet side of the fabric with 70% to 60% of the pile fibers. However, this percentage can be changed according to the end use and application of the fabric. If the fleece side of the fabric is the outside of a garment, then this side can be made to look fuller and richer by pulling up to 50% of the pile to the napped side. If the velvet side is on the outside of the garment, then only 10% to 20% of the fibers can be pulled to the fleece side of the fabric. This would leave the velvet side fuller, and the patterns would be clearer and better defined.

Besides a fleece finish on one side and a velvet on the other side, this fabric can also be colored and patterned. To enhance further the aesthetic value of this fabric, some surface texture is introduced by means of modifying the support structure of the fabric. Some of these textures are a change in pile direction in certain areas of the fabric. Other surface effects that can be created by a high and low pile on the velvet side of the fabric. Also the density of the fabric can be altered to have dense areas and more open areas in the fabric by modifying the support structure of the fabric. The end use of the fabric dictates the type of support structure to be used in the fabric.

FIGS. 6A–E show various knits that could be used for the present invention. These knits are hereinafter referred to as A1 . . . A5 respectively. If a more stable fabric is required, or if stretch and some texture is needed, knit constructions A2, A3 and A4 should be used.

The front support fabric is formed with the two outside yarn guide bars 1 and 2 on the front needle bar. The back support fabric is formed with the two other outside yarn guide bars 5 and 6 on the back needle bar on a 6 guide bar machine. Guide bars 6 and 7 and the back needle bar would form the support fabric on a 7 guide bar machine. To anyone familiar with the art of warp knitting, it is obvious that a large variety of knits, forming the support fabric, can be constructed with two yarn guide bars and a needle bar.

Knits A1 to A5 are but a small sample of possible knits. The fabric produced with knit A1 is a stable fabric with little stretch in both directions. By modifying the knit as shown in A2, a fabric with 40% to 50% stretch in the horizontal direction can be produced. By changing the same knit further as seen in A3, an additional stretch of 10% to 20% in vertical direction is made possible. Knits #A4 and A5 are mesh type knits and can be stretched up to 100% of their original width (i.e. the width of the fabric can be doubled). Stretch in these types of fabrics is of great importance. Fabrics of standard width are produced on standard equipment for different end uses. The fabric is then stretched to the required width a length in either direction on a tenter frame. After stretching, the fabric is stabilized by heat setting. Napping of the pile yarns is performed prior to the stretching. The new width can increase up to 100% of its original width.

An important feature of the fabrics A1–A5 is that when they are stretched, they can produce very unique distinct decorative patterns. This feature is best illustrated by fabric A4. Referring to FIG. 7A, it can be seen that the fabric A4 is structured so that some of the wales are connected (see wales 1, 2, 3, 7, 8, 9 . . . ) while other wales (4, 5, 6, 10, 11, 12 . . . ) are not connected. This structure allows the wales not connected to each other to separate as the fabric A4 is stretched sideways. Referring now to FIG. 7B, it can be seen that before stretching, the pile yarns forming the velvet, i.e. on the technical face, all extend substantially vertically and they are all parallel to each other. As previously discussed, the pile yarns are plaited around the substrate by loops, as seen in FIGS. 1, 4, 5A, 5B, 5C. Generally, there are three sets of pile yarns. Two sets are associated with the connected wales and the third set with the unconnected wales. As the fabric A4 is stretched sideways the pile yarn loops associated with connected wales are pulled sideways forcing the free ends or tips 21D of the pile yarn to bend either in one direction or another and are pulled partially onto the substrate. However, the yarns associated with the unconnected wales remain substantially vertical, as shown in FIG. 7C. The net result is that the straight pile yarns extend higher than the bent pile yarns, thus creating various patterns in the base or substrate and stretching it corresponding three dimensional patterns are generated with the pile yarns.

While this method is preferably used with fabric A4 being double sided, i.e. with a velvet on the technical face and a fleece on the technical back, it will work equally well if the technical back is not napped.

Figure 6A:
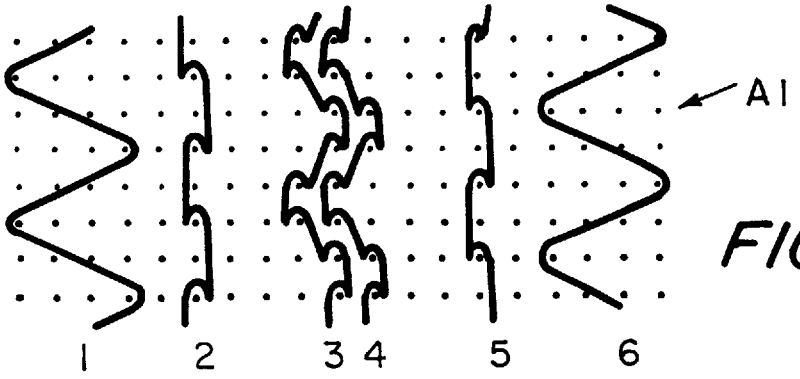
FIGS. 6A–6E show various knits that may be used for the subject invention.
Figure 6B:
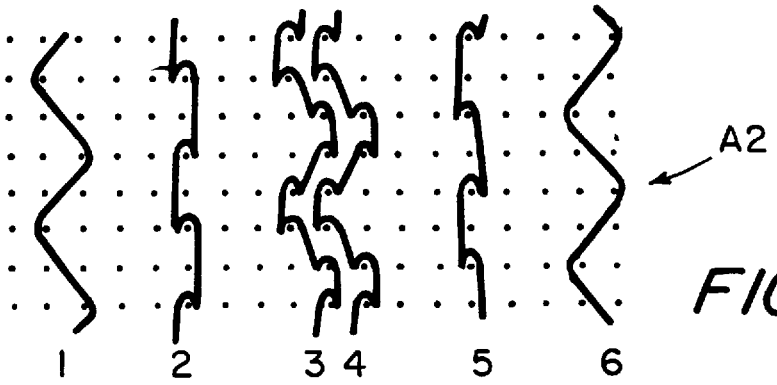
Figure 6C:
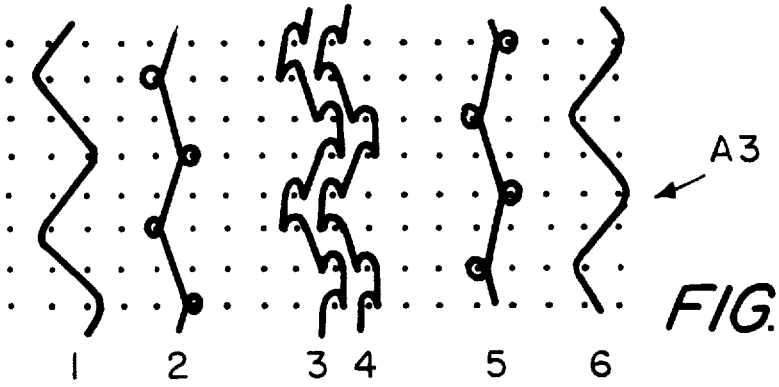
Figure 6D:
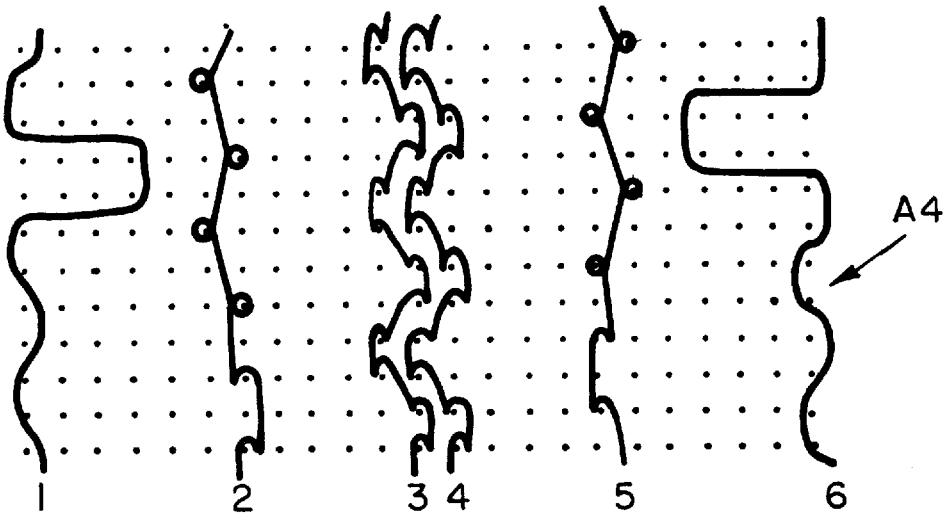
Figure 6E:
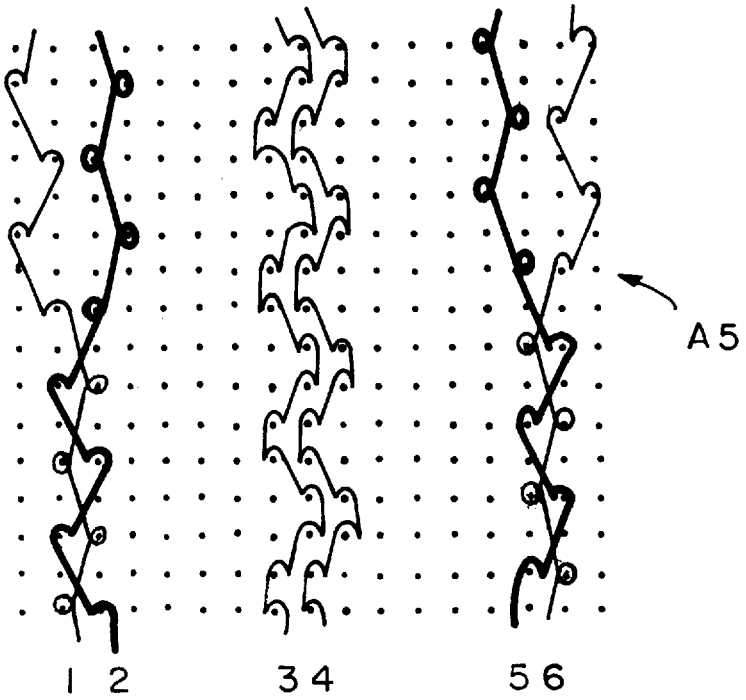

As seen in FIG. 6D as the fabric is stretched the separation between the wales is 3 stitches long. In the finished fabric these openings are covered on both sides with pile and only visible when the fabric is held against light. This separation will make the fabric light and lofty and at the same time it will retain its bulk.

Knit A5 is another of many mesh fabrics which can be produced with two guide bars and one needle bar, especially if the yarn guide bars 1, 2 and 6, 7 respectively have a none in, one out threading (1/1), or a two in two out threading (2/2). Both bars can also have variable threading which will produce a different type of texture. When a fabric with this knit is stretched in width direction, the wales which are not connected to each other will separate from each other and form openings larger than in knit A4 to produce a texture of different fiber densities on both side of the fabric.

It will thus be seen that the objects set forth above, and those made apparent from the preceding description, are efficiently attained, and since certain changes may be made in both the process and products described above without departing from the spirit and scope of the invention, it is intended that all matter contained in the above description shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

We claim:

1. A method of constructing a double face fabric comprising the steps of:

knitting a base fabric on a double bar knitting machine, said base fabric having two independent fabric layers interconnected by a plurality of pile yarns;

cutting across said pile yarns to form two intermediate fabrics, each intermediate fabric having a fabric layer with a technical face and a technical back, with said pile yarns extending along said technical face; and raising said technical back by pulling some of said pile yarns through said fabric layer.

2. The method of claim 1 wherein said technical back is raised by napping.

3. The method of claim 2 wherein each of said pile yarns is a composed of a plurality of filaments, and wherein said technical back is napped by pulling some of said filaments through said fabric layer.

4. The method of claim 3 wherein 20–80% of said filaments are pulled through said fabric layer.

5. The method of claim 3 wherein a predetermined percentage of filaments forming each pile yarn is pulled through said fabric layer.

6. The method of claim 5 wherein said predetermined percentage is about 20–80%.

7. The method of claim 6 wherein said predetermined percentage is about 30–50%.

8. The method of claim 1 further comprising processing said pile yarn prior to said raising to align said pile yarns so that said pile yarns can slide with respect to each other.

9. The method of claim 8 wherein said step of processing includes brushing said pile yarns.

10. A method of constructing a double face fabric comprising the steps of:

knitting a three dimensional base fabric having two parallel layers formed of stitch yarns, said layers being interconnected by pile yarns, each pile yarn being formed of several filaments, each pile yarn being plaited around at least one stitch yarn of each of said layers;

separating said base fabric by cutting said pile yarns to form two intermediate fabrics, each intermediate fabric having one of said fabric layers, a technical face and a technical back, with said pile yarns extending away the respective fabric layer along said technical face; and pulling some of the filaments of said pile yarns through said fabric layer.

11. The method of claim 10 wherein said filaments are pulled through said layer by napping.

12. The method of claim 11 wherein said pile yarns are plaited to form loops, said loops being oriented along a direction along said fabric layer and wherein said napping is performed along said direction.

13. The method of claim 10 further comprising processing said pile yarns after said separating step to align said pile yarns, whereby the said filaments can slide with respect to each other during said pulling step.

14. The method of claim 13 wherein said processing is selected from the steps including heating, steaming, brushing said pile yarns or a combination thereof.

15. The method of claim 10 further comprising brushing said technical back to form a fleece.

16. The method of claim 10 further comprising brushing said technical face to form a velvet.

17. The method of claim 10 further comprising rendering said pile yarn with a bulk greater than said stitch yarn.

18. The method of claim 17 wherein said pile yarn is rendered at least 1½ times greater than said stitch yarn.

19. The method of claim 10 further comprising texturing at least one of said faces.

20. A double faced fabric comprising:

a fabric layer formed of stitch yarns knitted together and having a face and a back; and a plurality of pile yarns, each pile yarn being plaited around one of said stitch yarns and including a first set and a second set of filaments, said first and second sets of filaments extending outwardly of said face to form a velvet, said second set of filaments extending outwardly of said back to form a fleece.

21. The fabric of claim 20 wherein said pile yarns have a bulk higher than said stitch yarns.

22. The fabric of claim 21 wherein said pile yarns have a bulk at least 1½ higher than said stitch yarns.

23. The fabric of claim 20 wherein said first and second set of filaments form tufts on said face, said tufts being arranged in a two dimensional array.

24. The fabric of claim 23 wherein said fleece is formed by said second set of filaments being arranged in a random pattern.

25. A method of making a double faced fabric comprising the steps of:

knitting a base fabric on a double bar knitting machine, said base fabric having two independent fabric layers interconnected by a plurality of pile yarns, said layers being structured to allow said layers in a predetermined direction;

cutting said pile yarns to form to intermediate fabrics, each intermediate fabric having a fabric layer with a technical face and a technical back with said pile yarns extending outwardly of said technical face;

raising said technical back by pulling portions of said pile yarns through said fabric layer to said technical back;

stretching one of said intermediate fabrics in said predetermined direction to form a stretched fabric; and stabilizing said stretched fabric.

26. The method of claim 25 wherein said predetermined direction is a width of said fabric.

27. The method of claim 25 wherein said intermediate fabric has a width and is stretched by 20%–100% of said width.

28. The method of claim 25 wherein said intermediate fabric is stretched in a longitudinal direction corresponding to the knitting direction.

29. A method of making a knitted fabric comprising the steps of:

knitting a fabric on a double bar knitting machine, said fabric being stretchable in a predetermined direction, said fabric including a base, a first set of wales and a second set of wales, said first and second set of wales being interlaced, said first set of wales being connected to said base and said second set of wales being unconnected and a plurality of pile yarns looped around said base and extending outwardly at least along one face of said fabric;

stretching said base fabric in said predetermined direction, with the pile yarns corresponding to said first set of wales being bent during said stretching to produce a three dimensional pattern; and stabilizing the stretched fabric.

30. The method of claim 29 wherein said pile yarns include a first yarn set and a second yarn set and wherein said first set of wales is arranged to force said first yarn set to bend a first direction during said stretching and to force said second yarn set to bend in a second direction opposite to said first direction.

31. A method of making a double-faced fabric with three dimensional patterns on at least one face, said method comprising the steps of:

knitting a base fabric on a double bar knitting machine, said base fabric including two parallel layers constructed of courses and wales, including a first set of wales and a second set of wales and a substrate, said first set of wales being connected to said substrate and said second set of wales being unconnected, and a plurality of interconnecting pile yarns, each yarn being plaited through each of said layers;

cutting said pile yarns to form two intermediate fabrics, each having a technical front with said pile yarns extending outwardly of said technical face to form a velvet, and a technical back;

processing said technical back by drawing some of said pile yarns through said substrate to form a fleece;

stretching said intermediate fabrics after said processing to force some of said yarns to bend while others of some yarns remain substantially normal to said substrate; and stabilizing said stretched intermediate fabrics.

32. The method of claim 31 wherein said pile yarns include a first set of yarns, a second set of yarns and a third set of yarns, said first and second set of yarns being associated with said first set of wales and said third set of yarns being associated with said second set of wales, comprising the step of knitting base with said first being constructed to bend said first and second set of pile yarns in opposite directions during said stretching.

33. The method of claim 32 further comprising the step of knitting said fabric with said second set of wales maintaining said third set of pile yarns substantially normal through to said substrate during said stretching.

34. The method of claim 31 wherein said pile yarns each include a first set of fibers and a second set of fibers, and said step of processing said technical back includes pulling said first set of fibers through said substrate.

35. The method of claim 31 wherein said step of processing said technical back includes napping said technical back.

* * * * *